US005553323A

United States Patent [19]

Chou et al.

[11] Patent Number: 5,553,323

[45] Date of Patent: Sep. 10, 1996

[54] FULL-OPEN TYPE UPPER GARMENT FOR PATIENTS

[76] Inventors: Chia-Tien Chou, 5th Fl., No. 2-9, Lane 159, Sec. 4 Mu Jah Rd., Taipei; Chao-Mu Chao, No. 2, Lane 197, Sec. 2, Her Tsuoh Rd., Her May Town, Chang Hwa, both of Taiwan

[21] Appl. No.: 273,190

[22] Filed: Jul. 11, 1994

[51] Int. Cl.[6] ..... A41B 1/00; A41D 1/00

[52] U.S. Cl. ..... 2/114; 2/105; 2/106; 2/69

[58] Field of Search ..... 2/46, 48, 50, 51, 2/52, 69, 69.5, 75, 80, 79, 84, 105, 106, 113, 114, 115, 125, 126, 912, 913, 914, 915

[56] References Cited

U.S. PATENT DOCUMENTS

| | | | |
|---|---|---|---|
| 818,351 | 4/1906 | Clark | 2/114 |
| 1,462,515 | 7/1923 | McElroy | 2/114 |
| 1,489,046 | 4/1924 | Thompson | 2/114 |
| 2,504,534 | 4/1950 | Kephart et al. | 2/114 |
| 2,675,555 | 4/1954 | Peronto | 2/105 |
| 3,453,662 | 7/1969 | Weiss | 2/115 X |
| 4,726,076 | 2/1988 | Douez | 2/69 |
| 4,993,077 | 2/1991 | Robison | 2/227 X |
| 5,331,685 | 7/1994 | Belgard | 2/114 X |

OTHER PUBLICATIONS

Gershman, Maurice, "Self Adhering Nylon Tapes." The J.A.M.A., vol. 168, No. 7, p. 930.

*Primary Examiner*—Jeanette E. Chapman
*Attorney, Agent, or Firm*—Bucknam and Archer

[57] ABSTRACT

An upper garment for patients which includes a back panel for covering over the back of a patient, two front panels sewed up with the back panel and fastened together by a zipper and respectively fastened to either side of the back panel by a respective zipper for covering over the front side of the upper body of the patient, two opposite sleeve panels respectively sewn up with the back panel and fastened up into a sleeve by a respective zipper in the longitudinal direction for covering around the hands of the patient.

1 Claim, 2 Drawing Sheets

FULL-OPEN TYPE UPPER GARMENT FOR PATIENTS

BACKGROUND OF THE INVENTION

The present invention relates to a full-open type upper garment particularly designed for patients which can be conveniently put on the sick and removed therefrom by the person who takes care of the sick.

Taking care of an apoplectic or paralytic patient is not an easy job. The person who takes care of the sick may have to expend a lot of time on dressing the sick. Therefore, there is a strong demand for garments specifically designed for the persons who are incapable of dressing themselves.

In order to satisfy this demand, the applicants invented an upper garment for patients and filed an application on Apr.29, 1993 under U.S. Pat. application Ser. No.08/055, 833.

The present invention provides a full-open type upper garment which allows each sleeve, the front half body panel and the back half body panel to be respectively opened during the examination. According to the preferred embodiment of the present invention, the upper garment comprises a back panel for covering over the back of a patient, two front panels sewed up with the back panel and fastened together by a zipper and respectively fastened to either side of the back panel by a respective zipper for covering over the front side of the upper body of the patient, two opposite sleeve panels respectively sewn up with the back panel and fastened up into a sleeve by a respective zipper in the longitudinal direction for covering around the hands of the patient. Therefore, either sleeve or the front half body panel (the front left panel and the front right panel form the front half body panel of the upper garment) of the upper garment can be conveniently opened when the doctor wishes to examine the patient.

DETAILED DESCRIPTION OF THE PREFERRED EMBODIMENT

Figure 1:
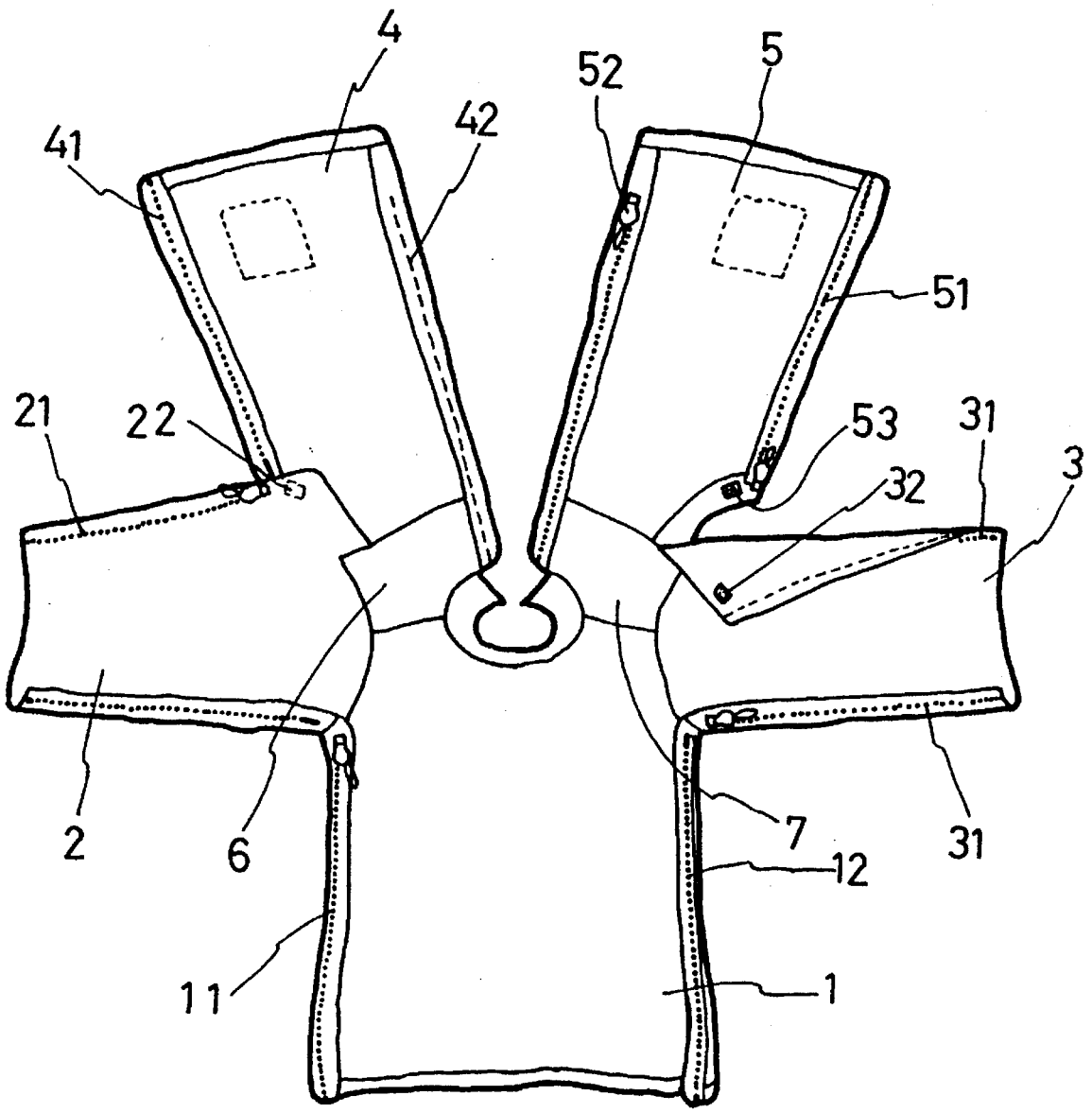
FIG. 1 is an extended out view of a full-open type upper garment according to the present invention.

Referring to FIG. 1, a full-open type upper garment in accordance with the present invention is generally comprised of a back panel 1, a left sleeve panel 2, a right sleeve panel 3, a front left panel 4, a front right panel 5, a left shoulder panel 6, and a right should panel 7 respectively connected together.

The back panel 1 is sewn up with the left and right sleeve panels 2 and 3, the front left and right panels 4 and 5 and the left and right shoulder panels 6 and 7, having a first zipper element 11 and a second zipper element 12 respectively longitudinally fastened to two opposite sides thereof for fastening the front left and right panels 4 and 5 respectively.

The left sleeve panel 2 has a top end sewn up with the back panel 1, having a zipper 21 longitudinally fastened to two opposite sides thereof and a fastening element (tape of loop and hook material) 22 at the back near the top end thereof for connection to the front left panel 4. When the zipper 21 is fastened up, the left sleeve panel 2 is set into a sleeve.

The right sleeve panel 3 has a top end sewn up with the back panel 1, having a zipper 31 longitudinally fastened to two opposite sides thereof and a fastening element (tape of loop and hook material) 32 at the back near the top end thereof for connection to the front right panel 5. When the zipper 31 is fastened up, the right sleeve panel 3 is set into a sleeve.

The front left panel 4 is sewn up with the left shoulder panel 6, comprising a first zipper element 41 along an outer side thereof for fastening up with the first zipper element 11 of the back panel 1, a second zipper element 42 along an inner side thereof, and a fastening element (tape of loop and hook material) 43 (not shown) near the top end thereof for connection to the fastening element 22 on the left sleeve panel 2.

The front right panel 5 is sewn up with the right shoulder panel 7, comprising a first zipper element 51 along an outer side thereof for fastening up with the second zipper element 12 of the back panel 1, a second zipper element 52 along an inner side thereof for fastening up with the second zipper element 42 of the front left panel 4, and a fastening element (tape of loop and hook material) 53 near the top end thereof for connection to the fastening element 32 on the right sleeve panel 2.

The left shoulder panel 6 is a substantially trapezoidal piece having three sides respectively sewn up with the back panel 1, the left sleeve panel 2 and the front left panel 4 and the other side spaced above the front left panel 4.

The right should panel 7 is a substantially trapezoidal piece having three sides respectively sewn up with the back panel 1, the right sleeve panel 3 and the front right panel 5 and the other side spaced above the front right panel 5.

Figure 2:
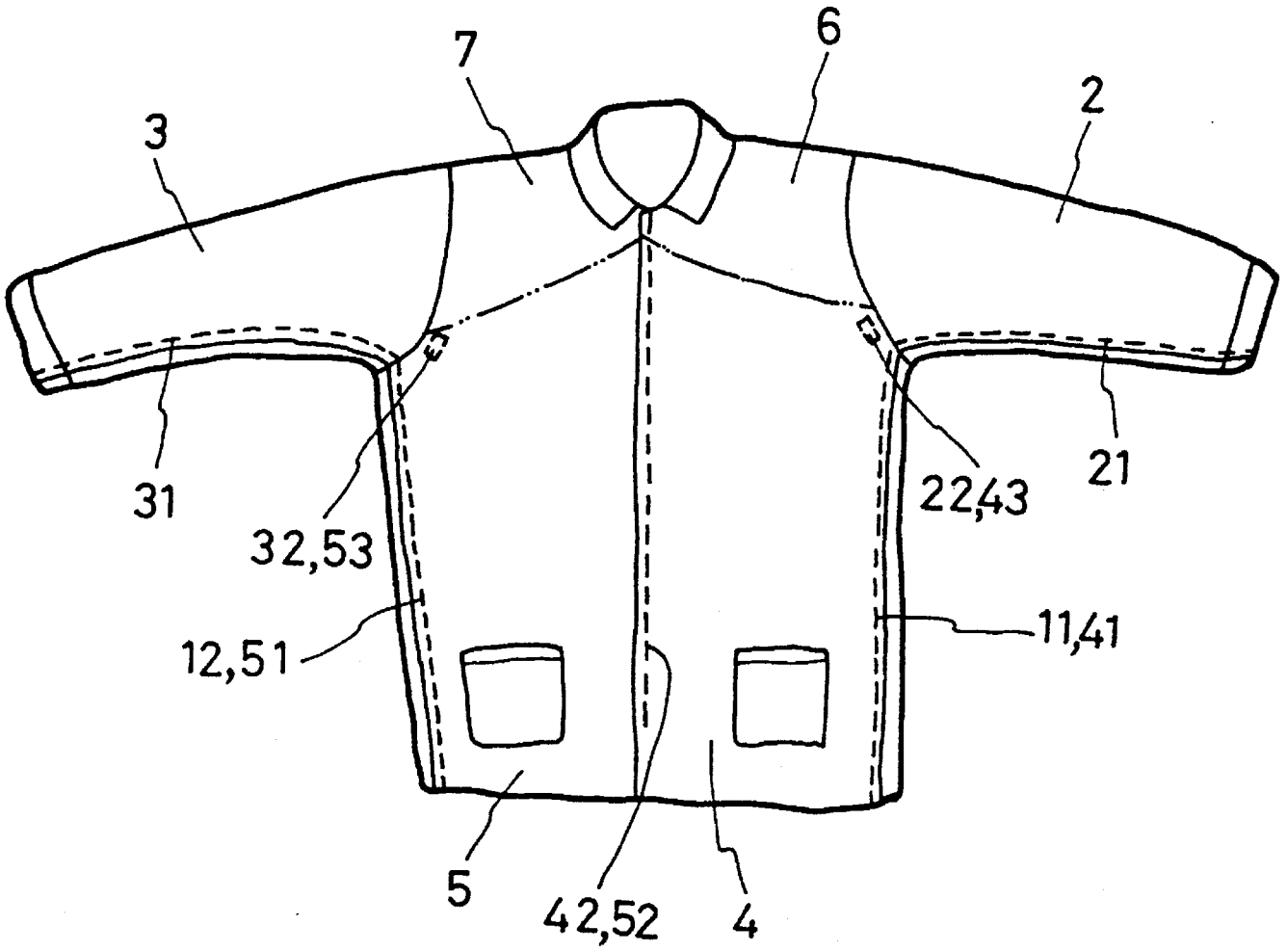
FIG. 2 shows the full-open type upper garment of FIG. 1 set up.

Referring to FIG. 2 again, when the full-open type upper garment is put on the patient, the zippers 21 and 31 are respectively fastened up, the first and second zipper elements 11 and 12 of the back panel 1 are respectively fastened up with the first zipper elements 41 and 51 of the front left and right panels 4 and 5, the second zipper elements 42 and 52 are fastened up, and the fastening elements 22 and 32 are respectively fastened up with the fastening elements 43 and 53.

When the doctor wishes to examine the patient, either sleeve or the front half body panel (the front left panel 4 and the front right panel 5 form the front half body panel of the upper garment) of the upper garment can be conveniently opened.

While only one embodiment of the present invention has been shown and described, it will be understood that various modifications and changed could be made thereunto without departing from the spirit and scope of the invention.

What is claimed is:

1. An upper garment for an apoplectic or paralytic patient comprising a back panel for covering over the back of the patient, a left sleeve panel for covering over the left arm of the patient, a right sleeve panel for covering over the right arm of the patient, a front left panel for covering over the front left side of the upper body of the patient, a front right panel for covering over the front right side of the upper body of the patient, a left shoulder panel for covering over the left shoulder of the patient, a right shoulder panel for covering over the right shoulder of the patient, wherein:

said back panel is sewn up with said left and right sleeve panels and said front left and right panels and said left and right shoulder panels, having a first zipper element and a second zipper element respectively longitudinally disposed along two opposite sides thereof;

said left sleeve panel is sewn up with said back panel and said left shoulder panel, having a zipper longitudinally fastened to two opposite sides thereof for fastening through a down stroke engagement said left sleeve panel around the left arm of the patient, and a tape of loop and hook material on said left sleeve panel;

said right sleeve panel is sewn up with said back panel and said right shoulder panel, having a zipper longitudinally fastened to two opposite sides thereof for fastening through a down stroke engagement said right sleeve panel around the left arm of the patient, and a tape of loop and hook material on said right sleeve panel;

said front left panel is sewn up with said left shoulder panel and said back panel, having a first zipper element along an outer side thereof for fastening up with the first zipper element of said back panel through a down stroke engagement, a second zipper element along an inner side thereof, and a tape of loop and hook material for fastening up with the tape of loop and hook material on said left sleeve panel; and said front right panel is sewn up with said right shoulder panel and said back panel, having a first zipper element along an outer side thereof for fastening up with the second zipper element of said back panel through a down stroke engagement, a second zipper element along an inner side thereof for fastening up with the second zipper element of said front left panel, and a tape of loop and hook material for fastening up with the tape of loop and hook material on said right sleeve panel, whereby any one of the left sleeve, the right sleeve, the front left panel, the front right panel can be opened for examination purposes.

* * * * *